US006923261B2

(12) United States Patent
Metcalfe et al.

(10) Patent No.: US 6,923,261 B2
(45) **Date of Patent: *Aug. 2, 2005**

(54) APPARATUS AND METHOD FOR EXPANDING A TUBULAR

(75) Inventors: Paul David Metcalfe, Peterculter (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/320,187

(22) Filed: Dec. 16, 2002

(65) Prior Publication Data

US 2003/0136561 A1 Jul. 24, 2003

Related U.S. Application Data

(63) Continuation of application No. 09/469,681, filed on Dec. 22, 1999, now Pat. No. 6,527,049.

(30) Foreign Application Priority Data

| | | |
|---|---|---|
| Dec. 22, 1998 | (GB) | 9828234 |
| Jan. 15, 1999 | (GB) | 9900835 |
| Oct. 8, 1999 | (GB) | 9923783 |
| Oct. 13, 1999 | (GB) | 9924189 |

(51) Int. Cl.[7] ..... E21B 23/02
(52) U.S. Cl. ..... 166/277; 166/206; 72/122
(58) Field of Search ..... 166/277, 206, 166/207; 72/120, 122

(56) References Cited

U.S. PATENT DOCUMENTS 761,518 A 5/1904 Lykken
958,517 A * 5/1910 Mettler ..... 166/217

(Continued)

FOREIGN PATENT DOCUMENTS

| | | | |
|---|---|---|---|
| DE | 3 213 464 | 10/1983 | B23D/45/12 |
| DE | 4 133 802 | 10/1992 | B09B/1/00 |

(Continued)

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.

U.S. Appl. No. 10/280,392, filed Oct. 25, 2002, Lauritzen et al.

U.S. Appl. No. 09/949,986, filed Sep. 10, 2001, Maguire et al.

U.S. Appl. No. 09/949,057, filed Sep. 07, 2001, Coon.

U.S. Appl. No. 09/938,176, filed Aug. 23, 2001, Coon.

U.S. Appl. No. 09/938,168, filed Aug. 23, 2001, Coon.

U.S. Appl. No. 09/712,789, filed Nov. 13, 2000, Simpson et al.

U.S. Appl. No. 09/469,643, filed Dec. 22, 1999, Metcalfe et al.

*Primary Examiner*—Hoang Dang
(74) *Attorney, Agent, or Firm*—Moser, Patterson & Sheridan, L.L.P.

(57) ABSTRACT

A method of isolating a section of downhole tubing comprises: running a length of expandable tubing (20) into a tubing-lined borehole (12, 14) and positioning the expandable tubing (20) across a section of tubing to be isolated; deforming at least portions of the expandable tubing (36, 40) to increase the diameter of the portions to sealingly engage the tubing (14) and to isolate the tubing section.

17 Claims, 3 Drawing Sheets

U.S. PATENT DOCUMENTS

| | | | | | |
|---|---|---|---|---|---|
| 988,054 | A | | 3/1911 | Wiet | |
| 1,301,285 | A | | 4/1919 | Leonard | |
| 1,324,303 | A | | 12/1919 | Carmichael | |
| 1,545,039 | A | | 7/1925 | Deavers | |
| 1,561,418 | A | | 11/1925 | Duda | |
| 1,569,729 | A | | 1/1926 | Duda | |
| 1,597,212 | A | | 8/1926 | Spengler | |
| 1,880,218 | A | | 10/1932 | Simmons | |
| 1,930,825 | A | | 10/1933 | Raymond | |
| 1,981,525 | A | | 11/1934 | Price | 166/4 |
| 2,017,451 | A | | 10/1935 | Wickersham | 166/10 |
| 2,134,311 | A | * | 10/1938 | Minor et al. | 166/379 |
| 2,214,226 | A | | 9/1940 | English | 166/1 |
| 2,216,226 | A | | 10/1940 | Bumpous | 36/44 |
| 2,383,214 | A | | 8/1945 | Prout | 153/82 |
| 2,424,878 | A | | 7/1947 | Crook | 154/82 |
| 2,499,630 | A | | 3/1950 | Clark | 153/81 |
| 2,519,116 | A | | 8/1950 | Crake | 166/10 |
| 2,627,891 | A | | 2/1953 | Clark | 153/82 |
| 2,633,374 | A | | 3/1953 | Boice | 285/118 |
| 2,663,073 | A | | 12/1953 | Bieber et al. | 29/148 |
| 2,898,971 | A | | 9/1959 | Hempel | 153/82 |
| 3,028,915 | A | | 4/1962 | Jennings | 166/16 |
| 3,039,530 | A | | 6/1962 | Condra | 166/55 |
| 3,087,546 | A | | 4/1963 | Wooley | 166/46 |
| 3,167,122 | A | | 1/1965 | Lang | 166/14 |
| 3,179,168 | A | | 4/1965 | Vincent | 166/14 |
| 3,186,485 | A | | 6/1965 | Owen | 166/63 |
| 3,191,677 | A | | 6/1965 | Kinley | 166/14 |
| 3,191,680 | A | | 6/1965 | Vincent | 166/46 |
| 3,195,646 | A | | 7/1965 | Brown | 166/208 |
| 3,203,451 | A | | 8/1965 | Vincent | 138/143 |
| 3,245,471 | A | | 4/1966 | Howard | 166/46 |
| 3,297,092 | A | | 1/1967 | Jennings | 166/207 |
| 3,326,293 | A | | 6/1967 | Skipper | 166/150 |
| 3,353,599 | A | | 11/1967 | Swift | 155/15 |
| 3,354,955 | A | | 11/1967 | Berry | 166/14 |
| 3,412,565 | A | * | 11/1968 | Lindsey et al. | 405/231 |
| 3,467,180 | A | | 9/1969 | Pensotti | 165/180 |
| 3,477,506 | A | | 11/1969 | Malone | 166/207 |
| 3,489,220 | A | | 1/1970 | Kinley | 166/277 |
| 3,583,200 | A | | 6/1971 | Cvijanovic et al. | 72/399 |
| 3,669,190 | A | | 6/1972 | Sizer et al. | 166/315 |
| 3,820,370 | A | | 7/1972 | Duffy | 72/75 |
| 3,689,113 | A | | 9/1972 | Hechstrasser et al. | 285/90 |
| 3,691,624 | A | | 9/1972 | Kinley | 29/253 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,785,193 | A | | 1/1974 | Kinley et al. | 72/393 |
| 3,818,734 | A | | 6/1974 | Bateman | 72/75 |
| 3,911,707 | A | | 10/1975 | Minakov et al. | 72/76 |
| 3,948,321 | A | | 4/1976 | Owen et al. | 166/277 |
| 3,977,076 | A | | 8/1976 | Vieira et al. | 30/103 |
| 4,069,573 | A | | 1/1978 | Rogers, Jr. et al. | 29/421 R |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,302,018 | A | * | 11/1981 | Harvey et al. | 277/322 |
| 4,319,393 | A | | 3/1982 | Pogonowski | 29/434 |
| 4,324,407 | A | | 4/1982 | Upham et al. | 277/27 |
| 4,349,050 | A | | 9/1982 | Bergstrom | 128/147 |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,429,620 | A | | 2/1984 | Burkhardt et al. | 91/395 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 |
| 4,502,308 | A | | 3/1985 | Kelly | 72/58 |
| 4,505,142 | A | | 3/1985 | Kelly | 72/54 |
| 4,505,612 | A | | 3/1985 | Shelley, Jr. | 405/101 |
| 4,531,581 | A | | 7/1985 | Pringle et al. | 166/120 |
| 4,567,631 | A | | 2/1986 | Kelly | 29/157.3 |
| 4,581,617 | A | | 4/1986 | Yoshimoto et al. | 346/108 |
| 4,588,030 | A | | 5/1986 | Blizzard | 166/120 |
| 4,626,129 | A | | 12/1986 | Kothmann | 405/43 |
| 4,697,640 | A | | 10/1987 | Szarka | 166/120 |
| 4,750,559 | A | | 6/1988 | Greenlee et al. | |
| 4,807,704 | A | | 2/1989 | Hsu et al. | 166/313 |
| 4,817,716 | A | * | 4/1989 | Taylor et al. | 166/277 |
| 4,848,469 | A | | 7/1989 | Baugh et al. | 166/382 |
| 4,866,966 | A | | 9/1989 | Hagen | 72/75 |
| 4,883,121 | A | | 11/1989 | Zwart | 166/217 |
| 4,976,332 | A | | 12/1990 | Hein | 175/57 |
| 4,997,320 | A | | 3/1991 | Hwang | 408/22 |
| 5,014,779 | A | | 5/1991 | Meling et al. | 166/55.7 |
| 5,052,483 | A | | 10/1991 | Hudson | 166/55 |
| 5,052,849 | A | | 10/1991 | Zwart | 403/300 |
| 5,156,209 | A | | 10/1992 | McHardy | 166/324 |
| 5,271,472 | A | | 12/1993 | Leturno | 175/107 |
| 5,301,760 | A | | 4/1994 | Graham | 175/61 |
| 5,307,879 | A | | 5/1994 | Kent | 166/382 |
| 5,322,127 | A | | 6/1994 | McNair et al. | 166/313 |
| 5,348,095 | A | | 9/1994 | Worrall et al. | 166/380 |
| 5,366,012 | A | | 11/1994 | Lohbeck | 166/277 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,520,255 | A | | 5/1996 | Barr et al. | 175/24 |
| 5,553,679 | A | | 9/1996 | Thorp | 175/73 |
| 5,560,426 | A | | 10/1996 | Trahan et al. | 166/120 |
| 5,636,661 | A | | 6/1997 | Moyes | 137/614.2 |
| 5,667,011 | A | | 9/1997 | Gill et al. | 166/295 |
| 5,685,369 | A | | 11/1997 | Ellis et al. | 166/195 |
| 5,706,905 | A | | 1/1998 | Barr | 175/61 |
| 5,785,120 | A | | 7/1998 | Smalley et al. | 166/55 |
| 5,887,668 | A | | 3/1999 | Haugen et al. | 175/79 |
| 5,901,787 | A | | 5/1999 | Boyle | 166/135 |
| 5,901,789 | A | | 5/1999 | Donnelly et al. | 166/381 |
| 5,924,745 | A | | 7/1999 | Campbell | 285/90 |
| 5,960,895 | A | | 10/1999 | Chevallier et al. | 175/27 |
| 5,979,571 | A | | 11/1999 | Scott et al. | 166/135 |
| 6,021,850 | A | | 2/2000 | Wood et al. | 166/380 |
| 6,029,748 | A | | 2/2000 | Forsyth et al. | 166/380 |
| 6,070,671 | A | | 6/2000 | Cumming et al. | 166/381 |
| 6,098,717 | A | | 8/2000 | Bailey et al. | 166/382 |
| 6,325,148 | B1 | | 12/2001 | Trahan et al. | 166/297 |
| 6,425,444 | B1 | | 7/2002 | Metcalfe et al. | 166/387 |
| 6,446,323 | B1 | | 9/2002 | Metcalfe et al. | 29/523 |
| 6,527,049 | B2 | | 3/2003 | Metcalfe et al. | 166/277 |
| 2001/0040054 | A1 | | 11/2001 | Haugen et al. | 175/61 |
| 2001/0045284 | A1 | | 11/2001 | Simpson | 166/313 |
| 2002/0145281 | A1 | | 10/2002 | Metcalfe et al. | 285/206 |
| 2002/0166668 | A1 | | 11/2002 | Metcalfe et al. | 166/378 |

FOREIGN PATENT DOCUMENTS

| | | | |
|---|---|---|---|
| EP | 0 961 007 | 12/1999 | E21B/33/10 |
| GB | 730338 | 5/1955 | |
| GB | 792886 | 4/1958 | |
| GB | 887150 | 1/1962 | |
| GB | 997 721 | 7/1965 | B21D/6/01 |
| GB | 1 277 461 | 6/1972 | B21D/39/04 |
| GB | 1 448 304 | 9/1976 | E21B/33/13 |
| GB | 1 457 843 | 12/1976 | B21D/39/10 |

| | | | |
|---|---|---|---|
| GB | 1 582 392 | 1/1981 | ..... B21D/39/10 |
| GB | 2 216 926 | 10/1989 | ..... E21B/7/20 |
| GB | 2 313 860 | 6/1997 | ..... E21B/10/34 |
| GB | 2 320 734 | 7/1998 | ..... E21B/33/127 |
| GB | 2 329 918 | 4/1999 | ..... E21B/43/10 |
| GB | 0 952 305 | 10/1999 | ..... E21B/43/10 |
| JP | SHO 63-207427 | 8/1988 | |
| RU | 2064357 C1 | 7/1996 | |
| RU | 2144128 C1 | 10/2000 | |
| WO | WO 92/01139 | 1/1992 | ..... E21B/17/08 |
| WO | WO 93/24728 | 12/1993 | ..... E21B/17/10 |
| WO | WO 94/25655 | 11/1994 | ..... D04C/1/06 |
| WO | WO 98/00626 | 1/1998 | ..... E21B/43/10 |
| WO | WO 99/02818 | 1/1999 | ..... E21B/43/10 |
| WO | WO 99/18328 | 4/1999 | ..... E21B/23/01 |
| WO | WO 99/23354 | 5/1999 | ..... E21B/43/10 |
| WO | WO 00/37773 | 6/2000 | ..... E21B/43/10 |
| WO | WO 01/60545 | 8/2001 | ..... B21D/39/00 |

* cited by examiner

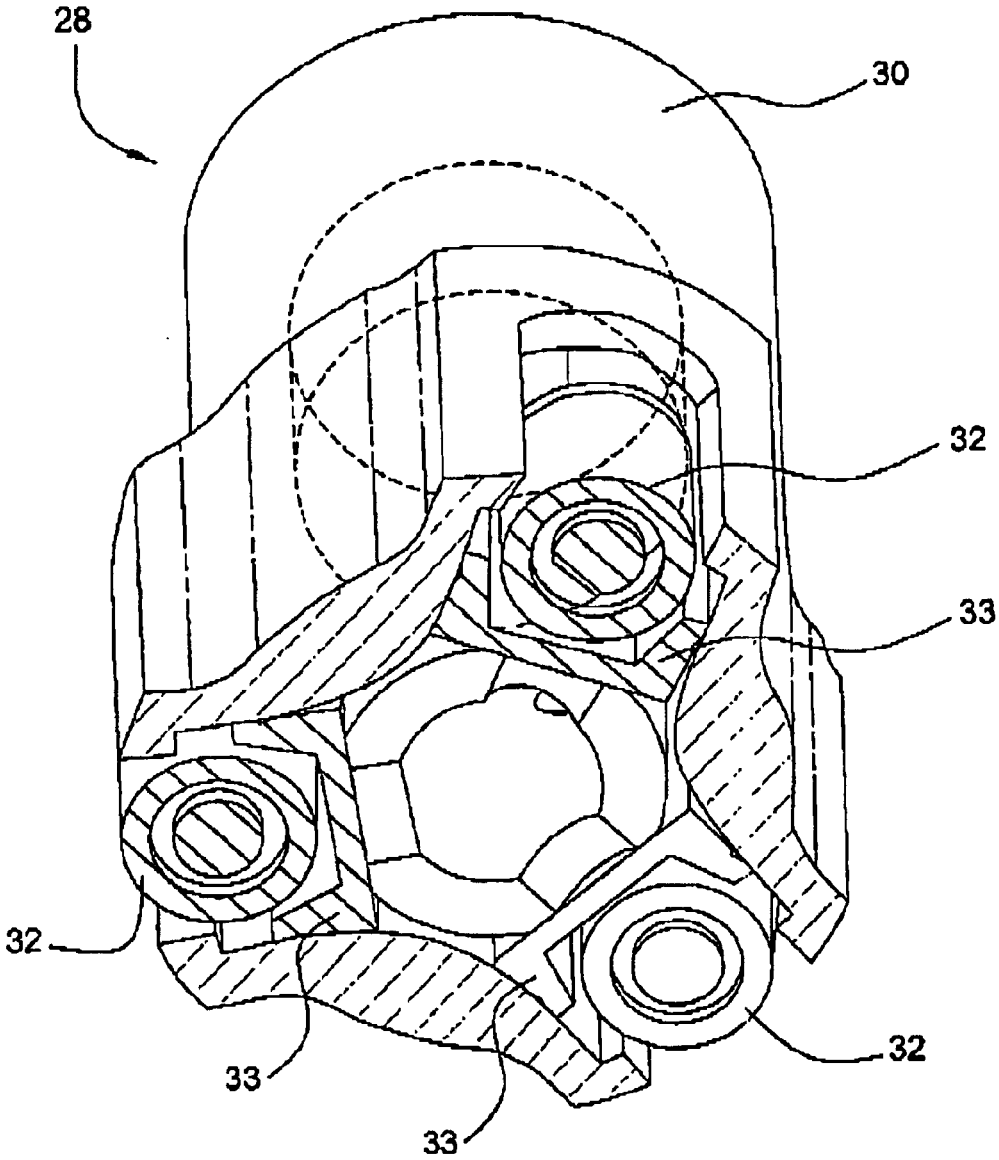
*Fig.* 4

APPARATUS AND METHOD FOR EXPANDING A TUBULAR

CROSS-REFERENCE TO RELATED APPLICATIONS

This application is a continuation of U.S. application Ser. No. 09/469,681 filed on Dec. 22, 1999, now U.S. Pat. No. 6,527,049. This application further claims benefit of GB 9828234.6 dated Dec. 22, 1998, GB 9900835.1 dated Jan. 15, 1999, GB 9923783.6 dated Oct. 8,1999, and GB 9924189.5 dated Oct. 13, 1999.

BACKGROUND OF THE INVENTION

1. Field of the Invention

This invention relates to a straddle, and in particular a straddle for use in selectively isolating a section of tubing. The invention also relates to a method of isolating a section of tubing.

2. Description of the Related Art

In the oil and gas exploration and production industries, subsurface hydrocarbon-bearing formations are accessed via casing-lined wellbores. The lower section of a bore, which intersects the hydrocarbon-bearing formation, is typically lined with perforated "liner", oil and gas flowing into the bore through the perforations. The location of the perforations is predetermined on the basis of surveys, to ensure that only selected formations are in fluid communication with the bore. Over the life of a well it may occur that the properties of particular formations change, for example the pressure in a formation may fall, or a formation may begin to produce any unacceptably high volume of water. In these circumstances it is known to run straddles into the liner, these straddles being sections of tubing with sealing arrangements at either end. A straddle may be located within the section of liner intersecting the problem formation, and the seals then set to isolate the section of liner between the seals. However, existing straddles are problematic to set, and the requirement to accommodate the seals and a seal setting mechanism result in a significant loss in bore cross section, which reduces the production capacity of the well and also makes it more difficult to access the section of well beyond the straddle.

SUMMARY OF THE INVENTION

It is among the objectives of embodiments of the present invention to provide an improved straddle which obviates or mitigates these difficulties.

According to the present invention there is provided a method of isolating a section of downhole tubing, the method comprising:

running a length of expandable tubing into a tubing-lined borehole and positioning the expandable tubing across a section of tubing to be isolated; and deforming the expandable tubing by increasing the diameter of at least portions thereof to sealingly engage the tubing and to isolate said section.

According to another aspect of the present invention there is provided apparatus for use in isolating a section of tubing-lined borehole, the apparatus comprising: a length of expandable tubing; and an expander device including a radially extendable member for deforming at least portions of the expandable tubing to increase the diameter of said portions to sealingly engage a section of tubing to be isolated.

Preferably, the expandable tubing is deformed by compressive plastic deformation or yield of the tubing and a localised reduction in tubing wall thickness with a subsequent increase in tubing diameter. Conveniently this is achieved by rolling expansion, that is the expander device is rotated within the expandable tubing with an expander member in rolling contact with an inner face of the expandable tubing.

The deformation of the expandable tubing preferably creates an annular extension. This annular extension may extend over all or a substantial portion of the expandable tubing, or may be restricted to a selected portions of the expandable tubing on either side of the section of tubing to be isolated. The former arrangement will be more secure, but would be more difficult to remove from the tubing.

The tubing lining the bore may be casing or liner, or may be secondary tubing, such as production tubing itself positioned within a section of casing or liner.

The expandable tubing may include relative ductile portions corresponding to the portions of the tubing to be expanded. These portions may be welded or otherwise secured to portions of less ductile tubing.

The expandable tubing is preferably initially cylindrical.

Preferably, the expander device 28 as shown in FIGS. 1 and 4 comprises a body 30 carrying a plurality of expander roller member 32. Most preferably, a plurality of the expander members 32 are radially extendable. Preferably, the expander members 32 are fluid activated, for example the members 32 may be operatively associated with a piston. In one embodiment illustrated in FIG. 4, the members 32 may be mounted on respective radially movable pistons 33 and in other embodiments the members may have tapered ends for engaging cones or wedges coupled to an axially movable piston.

The expandable tubing may carry seal bands on an outer surface thereof. The seal bands may comprise at least one of an elastomeric seal and a band of relatively ductile metal, such as copper or a tin/lead alloy.

The expandable tubing may carry grip bands on an outer surface thereof. The grip bands may comprise relatively hard elements, such as balls, chips or grains, held in a matrix, whereby the elements bite into the relatively soft material of the tubing and the expandable tubing on deformation of the expandable tubing. In other embodiments the relatively hard elements may be in a form other than bands.

BRIEF DESCRIPTION OF THE DRAWINGS

These and other aspects of the present invention will now be described, by way of example, with reference to the accompanying drawings, in which:

FIG. 4 is a cross-sectional perspective view of one embodiment of an expander device.

DETAILED DESCRIPTION OF THE PREFERRED EMBODIMENT

Figure 1:
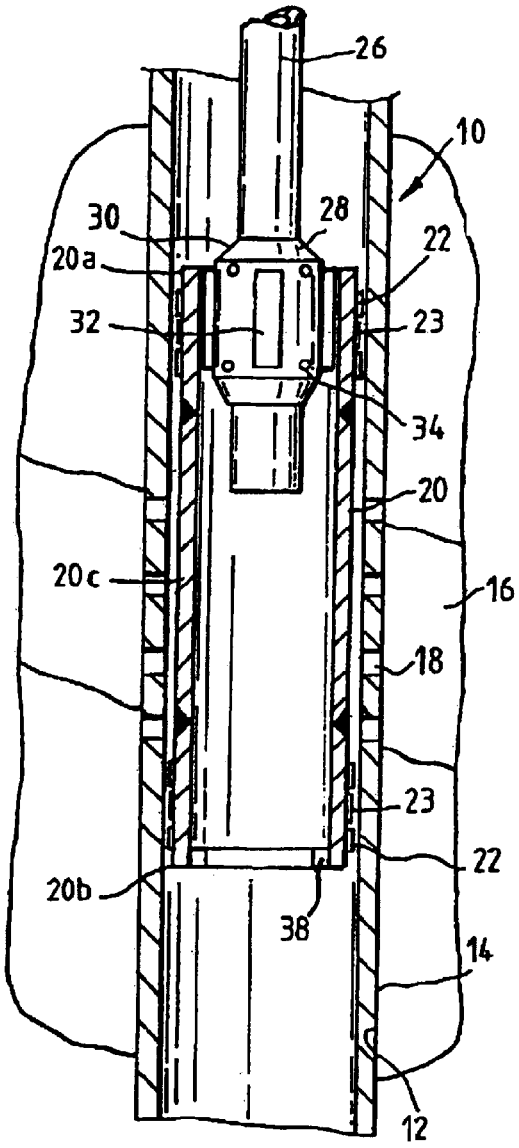
FIGS. 1 and 2 are schematic sectional views of a straddle setting operation in accordance with an embodiment of an aspect of the present invention.

Reference is first made to FIG. 1 of the drawings, which illustrates a straddle 10 in accordance with an embodiment of the present invention located in a section of a drilled bore 12 lined with perforated steel liner 14. The straddle 10 has been run into the bore 12 and will be utilised to isolate a section of the bore 12, in particular a particular formation 16 which is in fluid communication with the bore via perforations 18 in a section of the liner 14.

The straddle 10 comprises a section of expandable tubing 20 carrying seal bands 22 of relatively ductile metal at each end, and also grip bands 23 comprising small elements of relatively hard material in a relatively ductile matrix. The tubing 20 defines a solid wall and is of slightly smaller outside diameter than the liner 14. Initially, the tubing 20 is of substantially constant diameter along its length. The ends of the tubing 20*a*, 20*b* and formed of relatively ductile metal and are welded to a central tubing section 20*c*.

The straddle is run into the bore 12 on a tool string 26, and is mounted to the string 26 via an expander device 28 mounted to the lower end of the string 26. The expander device 28 comprises a body 30 carrying three radially movable rollers 32. The body 30 also contains an axially movable piston which is coupled to a loading cone which cooperates with the tapered ends of the rollers 32. Application of elevated fluid pressure, via the tool string 26, thus urges the rollers 32 radially outwardly. Shear pins 34 couple the straddle 10 to the expander body 30.

Figure 2:
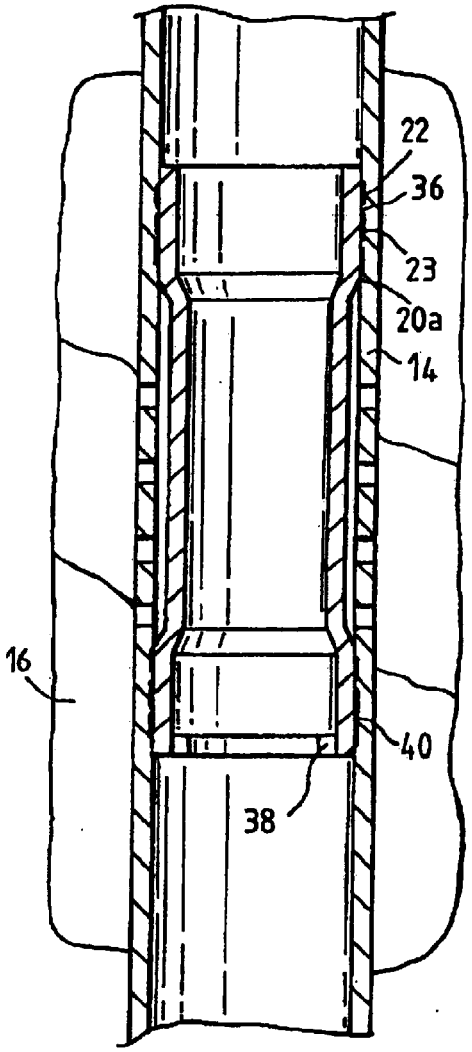

In use, the straddle is run into the bore 12 on the tool string 26 and positioned across the group of perforations 18 to be closed off from the bore. Pressure is then applied to the expander 28 to activate the rollers 32; an initial application of elevated pressure causes the rollers 32 to extend radially, and deforms the tubing 20, towards a triangular form, such that the areas of tubing 20 adjacent the rollers 32 are pushed into contact with the inner surface of the liner 14. This initial contact is sufficient to prevent relative rotation between the straddle 10 and the liner 14, such that when the string 26 and the expander 28 are rotated from surface the straddle 10 is held relative to the liner 14 and the pins 34 shear. The expander 28 then rotates with the straddle 10 with the rollers 32 in rolling contact with the inner wall of the tubing 20. The rollers 32 are urged outwardly and progressively compress the tubing wall to create a localised reduction in wall thickness, and a corresponding increase in wall diameter. There is thus created a annular section of increased tubing diameter 36 at the tubing end section 20*a*, as shown in FIG. 2, which provides an interference fit with the surrounding liner 14, the sealing bands 22 being deformed to form a fluid-tight seal between the expanded tubing 36 and the liner 14. The hard material in the grip bands 23 also assists in keying the tubing section 36 to the liner 14. There may be a degree of elastic and even plastic deformation of the liner 14, which will serve to provide a more secure location for the straddle 10.

Following creation of the annular extension 36, the pressure in the tool string 26 is reduced such that the rollers 32 may retract. The expander 28 is then advanced towards the lower end of the straddle 10, and engages a stop 38 provided on the lower end of the tubing 20. The pressure in the tool string is then increased once more to actuate the rollers 32, and the expander 28 is rotated to create a second annular section of increased diameter 40.

The expander 28 may then be deactivated and retrieved from the bore, leaving the straddle 10 locked in place in the bore, and serving to isolate the formation 16 from the bore.

To remove the straddle 10, the locking and sealing sections 36, 40 are milled out, and the remaining section of tubing then removed.

In other embodiments, the increased diameter sections 36, 40 may be formed simultaneously, by provision of two expanders located one at either end of the straddle.

Figure 3:
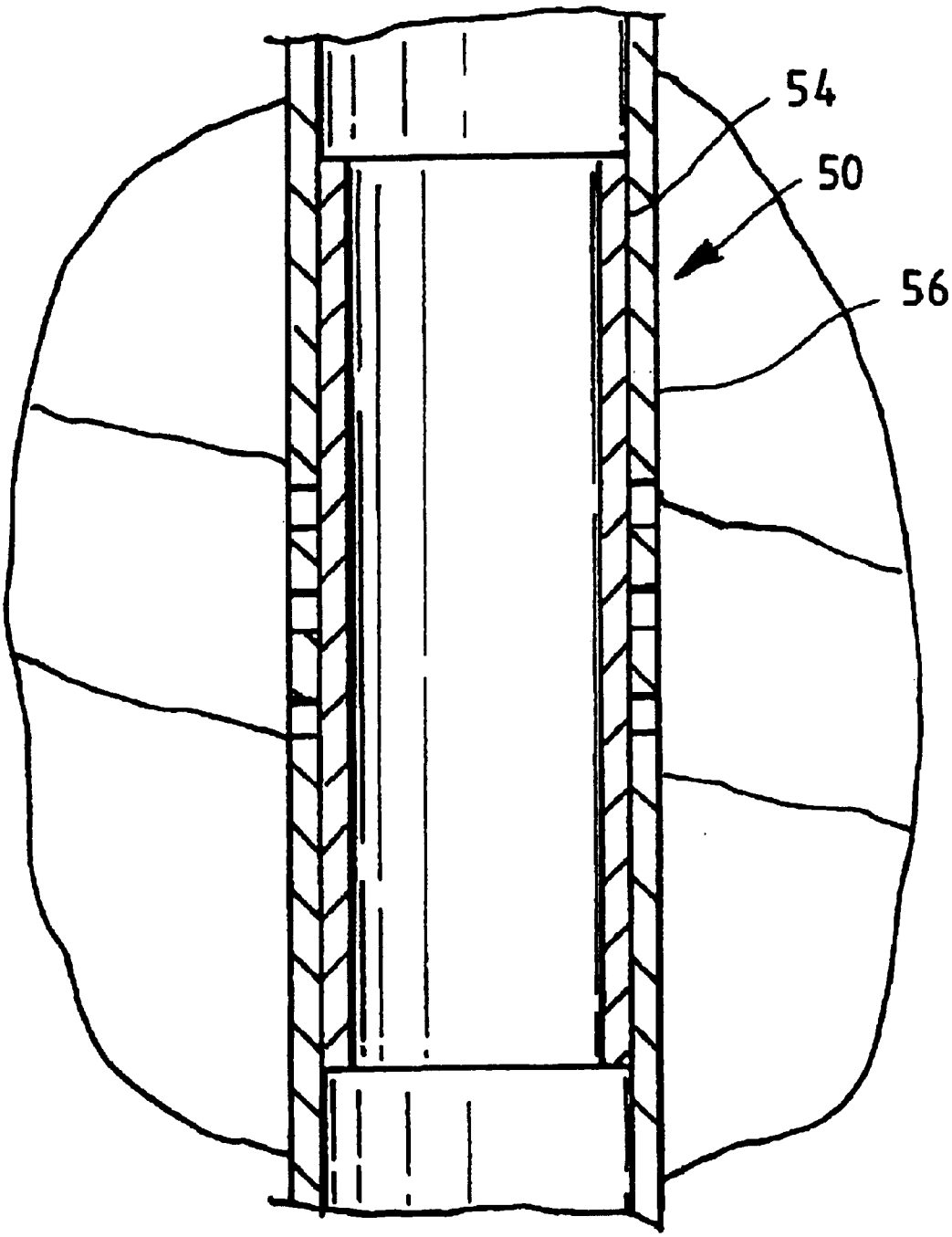
FIG. 3 is a schematic sectional view of a straddle in accordance with another embodiment of the present invention.

Reference is now made to FIG. 3 of the drawings, which illustrates a permanent straddle 50 in accordance with another embodiment of the invention locked and sealed in a bore 52. The straddle 50 is located in a substantially similar manner to the straddle 10 described above, however the straddle tubing 54 has been deformed along it whole length, such that there is a much larger area of contact between the tubing 54 and the surrounding liner 56, and a smaller loss in cross-section in the liner 56 from the provision of the straddle 50.

Those of skill in the art will recognise that the above described embodiments of the present invention provide straddles which are relatively simple in construction and installation and which avoid many of the problems associated with prior art straddles featuring slips and energisable elastomer seals.

Those of skill in the art will also recognise that the embodiments described herein are merely exemplary and that various modifications and improvements may be made thereto without departing from the scope of the present invention. For example, the above described embodiments are shown isolating sections of formation from a bore lined with perforated liner. In other embodiments, the straddle may be utilised to repair damaged tubing, including risers, casing, liner or production tubing. The straddle may be run in on any suitable form of tool string, including reeled supports such as coiled tubing, when the straddle will be provided in combination with a downhole motor for rotating the expander 28.

What is claimed is:

1. A method of expanding a first tubular into a second tubular in a wellbore comprising:

running the first tubular into the wellbore to a predetermined location within the second tubular;

expanding the first tubular into contact with the second tubular in at least one location using an expander tool, the tool including:

at least two piston-mounted, radially extending members, and expanding a longitudinal portion of the first tubular, the longitudinal portion covering apertures in the second tubular.

2. The method of claim 1, wherein expanding the first tubular into contact with the second tubular comprises rotating the expander tool relative to the first tubular.

3. The method of claim 2, wherein expanding the first tubular into contact with the second tubular further comprises radially extending the at least one radially extending member prior to rotating the expander tool relative to the first tubular.

4. The method of claim 1, wherein the at least one radially extending member expands the first tubular into contact with the second tubular.

5. The method of claim 1, wherein the expander tool comprises a plurality of radially extending members.

6. The method of claim 5, wherein the plurality of radially extending members is circumferentially spaced.

7. A method of expanding a first tubular into a second tubular in a wellbore comprising:

running the first tubular into the wellbore to a predetermined location within the second tubular;

expanding a portion of the first tubular into contact with the second tubular using an expander tool by extending at least two members of the expander tool in a radial direction while the at least two members are disposed within the first tubular; and expanding an extended length of the first tubular, wherein the extended length covers apertures in the second tubular.

8. The method of claim 7, wherein expanding the portion of the first tubular into contact with the second tubular comprises rotating the expander tool.

9. The method of claim 8, wherein the expander tool is rotated relative to the first tubular to expand the portion of the first tubular into contact with the second tubular.

10. The method of claim 7, wherein the expander tool is located within the first tubular when running the first tubular into the wellbore.

11. The method of claim 7, wherein the at least one member is piston mounted within the expander tool.

12. A method of expanding a first tubular into a second tubular in a wellbore comprising:

running the first tubular of an axial length into the wellbore to a predetermined location within the second tubular, the first tubular having an expander tool disposed therein;

radially extending at least two radially extendable members of the expander tool to expand a portion of the first tubular; and expanding substantially the entire axial length of the first tubular into sealing contact with a section of the second tubular having apertures therein using the at least two radially extendable members.

13. A method of expanding a first tubular into a second tubular in a wellbore comprising:

running the first tubular into the wellbore to a predetermined location within the second tubular; and expanding the first tubular into contact with the second tubular in at least one location using an expander tool, the expander tool including a plurality of piston-mounted, radially extending members.

14. The method of claim 13, wherein the plurality of radially extending members is unextended prior to the expander tool entering the first tubular.

15. The method of claim 13, wherein the plurality of radially extending members is extended after the expander tool is located within the first tubular.

16. The method of claim 13, wherein expanding the first tubular into contact with the second tubular in at least one location comprises rotating the expander tool relative to the first tubular.

17. The method of claim 13, wherein the plurality of radially extending members is axially spaced.

* * * * *